United States Patent [19]

Isogai et al.

[11] 4,448,754

[45] May 15, 1984

[54] MONOLITHIC CATALYST CATALYTIC CONVERTER WITH CATALYST HOLDING EXPANSIBLE RETAINER RING

[75] Inventors: Kiyoshi Isogai; Nobuo Tobi; Itsuo Koga; Masahiko Takeuchi; Makoto Okamoto; Nobuo Ohmori; Naka Takita, all of Toyota, Japan

[73] Assignee: Toyota Jidosha Kabushiki Kaisha, Toyota, Japan

[21] Appl. No.: 428,663

[22] Filed: Sep. 30, 1982

[30] Foreign Application Priority Data

Aug. 31, 1982 [JP] Japan ..... 57-151459

[51] Int. Cl.[3] ..... F01N 3/10

[52] U.S. Cl. ..... 422/179; 55/DIG. 30; 60/299; 422/180

[58] Field of Search ..... 422/177, 179, 180; 55/498, DIG. 30; 165/81; 60/299

[56] References Cited

U.S. PATENT DOCUMENTS

| | | | |
|---|---|---|---|
| 1,912,785 | 6/1933 | Mills | 165/81 |
| 3,854,888 | 12/1974 | Frietzsche et al. | 422/179 X |
| 3,945,803 | 3/1976 | Musall et al. | 422/179 |
| 4,115,071 | 9/1978 | Masuda et al. | 60/299 X |
| 4,161,509 | 7/1979 | Nowak | 422/179 |
| 4,353,873 | 10/1982 | Noritake et al. | 422/177 X |
| 4,362,700 | 12/1982 | Hayashi et al. | 60/299 X |

FOREIGN PATENT DOCUMENTS 2211522 9/1973 Fed. Rep. of Germany ..... 422/179

*Primary Examiner*—Richard L. Chiesa

*Attorney, Agent, or Firm*—Oblon, Fisher, Spivak, McClelland & Maier

[57] ABSTRACT

A catalytic converter includes a tubular casing within which is held a monolithic catalyst body which is generally of a columnar shape. The ends of the monolithic catalyst body are each engaged with a cushion ring, and each cushion ring is engaged with a retainer ring therefor, which is substantially axially fixed within the casing near to an end thereof. The monolithic catalyst body is supported within the casing by axial compressive force present between the retainer rings on the outside, the cushion rings between the retainer rings, and the monolithic catalyst body between the cushion rings. At least one of the retainer rings is formed with a break in a part of its circumference, the two free ends of the retainer ring on the two sides of the break being movable with distortion of the retainer ring through a certain distance, according to changes of temperature of the retainer ring, with respect to one another in the mutual relative direction which causes the overall circumference of the retainer ring to be diminished, so that expansion of the retainer ring when it heats up is absorbed, and the retainer ring is not subject to kinking or folding when the catalytic converter operates in the hot condition.

15 Claims, 4 Drawing Figures

MONOLITHIC CATALYST CATALYTIC CONVERTER WITH CATALYST HOLDING EXPANSIBLE RETAINER RING

BACKGROUND OF THE INVENTION

The present invention relates to a catalytic converter for the exhaust system of an automotive vehicle, and more particularly relates to a catalytic converter for the exhaust system of an automotive vehicle, which is of the so called monolithic catalyst type, and which is provided with a means for coping with variations in the operating temperature of the parts thereof.

Catalytic converters are in wide use nowadays for purifying the exhaust gases from internal combustion engines of automotive vehicles. When exhaust gases are passed through such a catalytic converter they may be purified of HC and CO and unburnt hydrocarbons contained therein, as well as being purified of nitrogen oxides (generically referred to as NOx) which they contain. A common type of such a catalytic converter is the so called monolithic type catalytic converter, which incorporates a so called monolithic catalyst body. This monolithic catalyst body is made of an integral mass of ceramic material, which used as a catalyst carrier, and which has a honeycomb structure which has a very large surface area. Catalytic metal is carried by this mass of ceramic material as laid in a thin layer on its said very large surface area. Ceramic material is used for the carrier because it is suitable for being formed into the requisite finely detailed shape and because it is capable of withstanding the high temperatures associated with such catalytic action, and because further it does not disturb the catalytic action of the catalyst metal laid thereon; but the difficulty has arisen that such a ceramic material is rather brittle and fragile, and accordingly the mounting of such a monolithic catalyst body within the tubular casing or body of the monolithic catalytic converter, in such a way that the monolithic catalyst body is protected from vibration and shock, such as for example vibration and shock caused by the operation of the internal combustion engine, so that it can be expected to have a long service life, is difficult. Further, the difficulty of mounting the monolithic catalyst body within the tubular casing of the monolithic catalytic converter is greatly aggravated by the fact that the thermal expansion coefficients of the ceramic material of the monolithic catalyst body and of the metal which typically forms said tubular casing of the monolithic catalytic converter are very different, and accordingly under the high temperatures characteristic of the catalytic conversion process performed by the monolithic catalyst body, which can easily exceed 800° C., the differential expansion of said ceramic material of the monolithic catalyst body and of the metal of said tubular casing of the monolithic catalytic converter is very considerable. The differential expansion can impose stresses on the monolithic catalyst body which are quite capable of fracturing its relatively brittle and fragile structure, unless adequate means are utilized for properly mounting the monolithic catalyst body within the tubular casing of the monolithic catalytic converter.

A method which has been adopted in the past of holding the monolithic catalyst body within the tubular casing of the monolithic catalytic converter has been for the monolithic catalyst body, which is of a generally columnar shape, to be held between two cushion rings at its two opposite ends, said cushion rings being manufactured of a relatively soft substance. Thus the monolithic catalyst body has been axially held with a certain amount of cushioning which has been sufficient to allow for the differential expansion of the monolithic catalyst body and the tubular casing of the monolithic catalytic converter within which it is held; and also these cushion rings protect the monolithic catalyst body from vibration and other shock, such as for example vibration and shock due to the operation of the internal combustion engine to which the monolithic catalytic converter is attached, to which it might be otherwise subjected. Further, the monolithic catalyst body has been held, with regard to its radial positioning within the tubular casing of the monolithic catalytic converter, by means including wire mesh and/or foamed thermally resistant material, said means being interposed between the outside surface of the monolithic catalyst body and the inside cylindrical surface of said tubular casing of the monolithic catalytic converter, and said radial clamping further protecting the monolithic catalyst body from vibration and other shock. Further, it has been conventionally known and practiced for these cushion rings to be engaged with retainer rings which hole them within the tubular casing of the monolithic catalytic converter. If these retainer rings are appropriately designed, they can prevent the cushion rings from coming into direct contact with the relatively hot exhaust gases which are being emitted by the internal combustion engine and are being flowed through the monolithic catalytic converter to purify them. This is important because the material of which the cushion rings are made, which needs to be relatively soft and needs to provide a certain cushioning function, is necessarily less resistant to the hot exhaust gases than the material of such retainer rings, which is typically steel, in particular stainless steel. The retainer rings also can perform the very important function of keeping the cushion rings in proper shape, preventing them from becoming shifted or distorted or from being displaced from their proper positioning as holding the columnar monolithic catalyst body. This again is important because the material of which the cushion rings are made is as stated above relatively soft and accordingly is more liable to distortion than the material of such retainer rings.

Now, typically, the interior periphery of such a retainer ring is directly exposed to the full temperature of the exhaust gases which are being emitted by the internal combustion engine and are being flowed through the monolithic catalytic converter to purify them, and the temperature of these exhaust gases can attain 800° C. Accordingly, the interior periphery of such a retainer ring can attain a temperature of 600° C. to 650° C. On the other hand, the exterior periphery of such a retainer ring is typically in contact with or is very close to the inner surface of the tubular casing of the monolithic catalytic converter, and accordingly is kept fairly cool. Thus the inner periphery of the retainer ring is typically heated up to a much higher temperature than the outer periphery thereof. Further, since as stated above typically the exterior periphery of such a retainer ring is in contact with the relatively cool inner surface of the tubular casing of the monolithic catalytic converter, the radial expansion of the retainer ring is typically substantially prevented. Accordingly, the problem of differential heating of such a retainer ring becomes acute, and the retainer ring is liable to undergo thermal deformation such as waviness, during use of the monolithic catalytic converter. Such waviness or other deformation of the retainer ring has the detrimental effect that the retainer ring thereby becomes much less able properly to hold the cushion ring, and accordingly it is risked that the cushion ring should become displaced from its proper position, thereby causing the holding of the monolithic catalyst body by the cushion ring to fail, which can allow the monolithic catalyst body to thereafter become damaged by shock and/or vibration. Further, the deformation of the retainer ring can allow the impact of hot exhaust gases on the cushion ring or upon the means for radially positioning the monolithic catalyst body within the tubular casing of the monolithic catalytic converter such as the aforementioned wire mesh and/or foamed thermally resistant material interposed between the outside surface of the monolithic catalyst body and the inside cylindrical surface of said tubular casing of the monolithic catalytic converter, and this impact of hot exhaust gases can deteriorate said cushion ring or the material of said radial positioning means, thus again perhaps causing the holding of the monolithic catalyst body by the cushion ring to fail or allowing the monolithic catalyst body to become damaged by shock and/or vibration.

A further disadvantage of the above outlined prior art type of retainer ring for a monolithic catalytic converter is that such a retainer ring has been typically manufactured out of a costly material such as stainless steel, which is resistant to the hot exhaust gases over a long period of time, by such a process as stamping out of stainless steel plate and deburring, for example. Now, such a method of construction tends to waste at least 80% of the stainless steel plate material, which is very costly and troublesome, and is ecologically unsound.

SUMMARY OF THE INVENTION

Accordingly, it is the primary object of the present invention to provide a monolithic catalytic converter of the general construction outlined above, incorporating such a monolithic catalyst body, which avoids the difficulties outlined above with respect to the prior art.

It is a further object of the present invention to provide such a monolithic catalytic converter, incorporating such a monolithic catalyst body, which allows the monolithic catalyst body to have a long service life.

It is a further object of the present invention to provide such a monolithic catalytic converter, incorporating such a monolithic catalyst body, in which a ceramic monolithic catalyst body may be freely used without encountering any breakage problems therewith.

It is a further object of the present invention to provide such a monolithic catalytic converter, incorporating such a monolithic catalyst body, which adequately prevents the catalyst body from damage.

It is a further object of the present invention to provide such a monolithic catalytic converter, incorporating such a ceramic monolithic catalyst body, in which the brittleness and fragility inevitably associated with such a ceramic monolithic catalyst body do not result in poor performance or premature failure of the catalytic converter as a whole.

It is a further object of the present invention to provide such a monolithic catalytic converter, incorporating such a monolithic catalyst body, in which the catalyst body is properly mounted within the casing of said catalytic converter.

It is a further object of the present invention to provide such a monolithic catalytic converter, incorporating such a monolithic catalyst body, in which the catalyst body is mounted within the casing of said monolithic catalytic converter so as to be properly protected against shock.

It is a further object of the present invention to provide such a monolithic catalytic converter, incorporating such a monolithic catalyst body, in which the catalyst body is mounted within the casing of said monolithic catalytic converter so as to be properly protected against vibration.

It is a further object of the present invention to provide such a monolithic catalytic converter, incorporating such a monolithic catalyst body, in which the catalyst body is mounted within the casing of said catalytic converter so as to be properly protected against differential expansion caused by difference between the coefficient of thermal expansion of said catalyst body and the coefficient of thermal expansion of said casing of said catalytic converter.

It is a further object of the present invention to provide such a monolithic catalytic converter, incorporating such a monolithic catalyst body, in which the catalyst body is held with proper cushioning within the casing of said catalytic converter so as to allow for differential expansion between said catalyst body and said casing of said catalytic converter caused by difference between the coefficent of thermal expansion of said monolithic catalyst body and the coefficient of thermal expansion of said casing of said monolithic catalytic converter.

It is a further object of the present invention to provide such a monolithic catalytic converter, incorporating such a monolithic catalyst body and such cushion rings for axially holding said monolithic catalyst body, in which the cushion rings are properly held in place.

It is a further object of the present invention to provide such a monolithic catalytic converter, incorporating such a monolithic catalyst body and such cushion rings for axially holding said monolithic catalyst body, in which the cushion rings are properly protected from being damaged by the hot exhaust gases flowing through said monolithic catalytic converter.

It is a further object of the present invention to provide such a monolithic catalytic converter, incorporating such a monolithic catalyst body, such cushion rings for axially holding said monolithic catalyst body, and such radial bracing means for the monolithic catalyst body as described above, in which the radial bracing means is properly protected from being damaged by the hot exhaust gases flowing through the monolithic catalytic converter.

It is a further object of the present invention to provide such a monolithic catalytic converter, incorporating such a monolithic catalyst body and such cushion rings for axially holding said monolithic catalyst body, in which the cushion rings are properly protected from being distorted.

It is a further object of the present invention to provide such a monolithic catalytic converter, incorporating such a monolithic catalyst body and such cushion rings for axially holding said monolithic catalyst body, in which the cushion rings are properly protected from slipping out of their proper positions.

It is a further object of the present invention to provide such a monolithic catalytic converter, incorporating such a monolithic catalyst body and such cushion rings for axially holding said monolithic catalyst body, in which the cushion rings are kept in their proper shapes.

It is a further object of the present invention to provide such a monolithic catalytic converter, incorporating such a monolithic catalyst body, such cushion rings for axially holding said monolithic catalyst body, and such retainer rings for holding the cushion rings, in which the retainer rings are kept from becoming deformed.

It is a further object of the present invention to provide such a monolithic catalytic converter, incorporating such a monolithic catalyst body, such cushion rings for axially holding said monolithic catalyst body, and such retainer rings for holding the cushion rings, in which the retainer rings are kept from becoming wavy.

It is a further object of the present invention to provide such a monolithic catalytic converter, incorporating such a monolithic catalyst body, such cushion rings for axially holding said monolithic catalyst body, and such retainer rings for holding the cushion rings, in which expansion of the retainer rings due to heating up thereof by the exhaust gases is properly absorbed.

It is a further object of the present invention to provide such a monolithic catalytic converter, incorporating such a monolithic catalyst body, such cushion rings for axially holding said monolithic catalyst body, and such retainer rings for holding the cushion rings, in which in particular differential expansion of the retainer rings due to differential heating up thereof by the exhaust gases is properly absorbed.

It is a further object of the present invention to provide such a monolithic catalytic converter, incorporating such a monolithic catalyst body, such cushion rings for axially holding said monolithic catalyst body, and such retainer rings for holding the cushion rings, in which in particular differential expansion of the retainer rings due to heating up of the central portions thereof by the exhaust gases to hotter temperatures than the outer portions thereof is properly absorbed.

It is a further object of the present invention to provide such a monolithic catalytic converter, incorporating such a monolithic catalyst body, such cushion rings for axially holding said monolithic catalyst body, and such retainer rings for holding the cushion rings, in which it is prevented that deformation of the retainer rings due to heating up by the exhaust gases should cause the cushion rings to be exposed to the hot exhaust gases.

It is a further object of the present invention to provide such a monolithic catalytic converter, incorporating such a monolithic catalyst body, such cushion rings for axially holding said monolithic catalyst body, such radial bracing means for the monolithic catalyst body as described above, and such retainer rings for holding the cushion rings, in which it is prevented that deformation of the retainer rings due to heating up thereof by the exhaust gases should cause the radial bracing means for the monolithic catalyst body to be exposed to the hot exhaust gases.

It is a further object of the present invention to provide such a monolithic catalytic converter, incorporating such a monolithic catalyst body, such cushion rings for axially holding said monolithic catalyst body, such radial bracing means for the monolithic catalyst body as described above, and such retainer rings for holding the cushion rings, in which it is prevented that deformation of the retainer rings due to heating up by the exhaust gases should cause the radial bracing means for the monolithic catalyst body to lose its elasticity due to exposure to the hot exhaust gases.

It is a further object of the present invention to provide such a monolithic catalytic converter, incorporating such a monolithic catalyst body, such cushion rings for axially holding said monolithic catalyst body, and such retainer rings for holding the cushion rings, in which the retainer rings are not subjected to substantial thermal stresses when they are hot.

It is a further object of the present invention to provide such a monolithic catalytic converter, incorporating such a monolithic catalyst body, such cushion rings for axially holding said monolithic catalyst body, and such retainer rings for holding the cushion rings, in which the retainer rings are not substantially kinked when they are hot.

It is a further object of the present invention to provide such a monolithic catalytic converter, incorporating such a monolithic catalyst body, such cushion rings for axially holding said monolithic catalyst body, and such retainer rings for holding the cushion rings, in which the retainer rings do not undergo substantial waviness when they are hot.

It is a further object of the present invention to provide such a monolithic catalytic converter, incorporating such a monolithic catalyst body, such cushion rings for axially holding said monolithic catalyst body, and such retainer rings for holding the cushion rings, in which the monolithic catalyst body is substantially prevented from becoming loose in the tubular casing of the monolithic catalytic converter.

It is a yet further object of the present invention to provide such a monolithic catalytic converter, incorporating such a monolithic catalyst body, in which leakage of the monolithic catalytic converter is substantially prevented.

It is a yet further object of the present invention to provide such a monolithic catalytic converter, incorporating such a monolithic catalyst body, in which premature failure of the monolithic catalytic converter is substantially guarded against.

It is a yet further object of the present invention to provide such a monolithic catalytic converter, incorporating such a monolithic catalyst body, which is easy to manufacture.

It is a yet further object of the present invention to provide such a monolithic catalytic converter, incorporating such a monolithic catalyst body, which is cheap to manufacture.

It is a yet futher object of the present invention to provide such a monolithic catalytic converter, incorporating such a monolithic catalyst body, during the manufacture of which waste of materials is avoided.

It is a yet further object of the present invention to provide such a monolithic catalytic converter, incorporating such a monolithic catalyst body, during the manufacture of which the efficiency of utilization of raw materials can be brought close to 100%.

It is a yet further object of the present invention to provide such a monolithic catalytic converter, incorporating such a monolithic catalyst body, such cushion rings for axially holding said monolithic catalyst body, and such retainer rings for holding the cushion rings, in which the retainer rings are not required to be formed out of sheet material.

It is a yet further object of the present invention to provide such a monolithic catalytic converter, incorporating such a monolithic catalyst body, such cushion rings for axially holding said monolithic catalyst body, and such retainer rings for holding the cushion rings, in which the retainer rings can be formed out of band material.

It is a yet further object of the present invention to provide such a monolithic catalytic converter, incorporating such a monolithic catalyst body, which is reliable in use.

It is a yet further object of the present invention to provide such a monolithic catalytic converter, incorporating such a monolithic catalyst body, which confers good drivability on a vehicle which incorporates it.

It is a yet further object of the present invention to provide such a monolithic catalytic converter, incorporating such a monolithic catalyst body, which is ecologically sound.

According to the present invention, these and other objects are accomplished by a monolithic catalytic converter, comprising: a tubular casing which has first and second ends; a monolithic catalyst body which is generally of a columnar shape and which has first and second ends; a first and a second cushion ring, which are respectively engaged with said first and second ends of said monolithic catalyst body; and a first and a second retainer ring, said first retainer ring being engaged with said first cushion ring and said second retainer ring being engaged with said second cushion ring, said first retainer ring being substantially fixed within said casing near said first end of said casing with respect to said casing with regard to axial movement of said first retainer ring away from said monolithic catalyst body, and said second retainer ring being substantially fixed with respect to said casing within said casing near said second end of said casing with regard to axial movement of said second retainer ring away from said monolithic catalyst body; said monolithic catalyst body being supported within said casing by axial compressive force present between said first retainer ring, said first cushion ring, said monolithic catalyst body, said second cushion ring, and said second retainer ring in the specified order; one of said first and second retainer rings being formed with a break in a part of its circumference, the two free ends of said retainer ring on the two sides of said break being movable with distortion of said retainer ring through a certain distance in the cold state of said retainer ring with respect to one another in the mutual relative direction which causes the overall circumference of said retainer ring to be diminished.

According to such a structure, when hot exhaust gases of an internal combustion engine are passed through the monolithic catalytic converter for some time in order to purify them, and when accordingly the monolithic catalytic converter becomes heated to a high temperature, then, since said one of said retainer rings is formed with said break in said part of its circumference, as the circumferential length of said one of said retainer rings increases differentially with respect to the circumference of the inside of said casing of said monolithic catalytic converter due to its being thus heated up, by the movement of the two free ends of said retainer ring on the two sides of said break with respect to one another in the mutual relative direction which causes the overall circumference of said retainer ring to be diminished, which is possible as explained above, said increase in the circumferential length of said one of said retainer rings is absorbed. Thereby the stress which would otherwise be set up in said one of said retainer rings, if the expansion (and also particularly the differential expansion between the inner portions and the outer portions) in the circumferential length thereof were not thus relieved and if said one of said retainer rings was prevented from such substantially free expansion, is avoided; and hence waviness and kinking of said one of said retainer rings, when it is hot, are substantially prevented from occurring. This means that leakage of hot exhaust gases within the monolithic catalytic converter is effectively prevented, and thus the cushion rings and the radial bracing means for the monolithic catalyst body (if such there be) are prevented from being exposed to the deleterious action of the hot exhaust gases flowing within the monolithic catalytic converter, and are accordingly prevented from being distorted and damaged, and from losing their elasticity. Thus, the cushion rings are kept in their proper shapes, and are prevented from slipping out of their proper positions within the casing of the monolithic catalytic converter as bracing the monolithic catalyst body therein. Thereby, the monolithic catalyst body is securely and reliably held in place within said casing of the monolithic catalytic converter, even after a long period of service, and is properly protected against damage due to shock and vibration, and also against the effects of differential expansion caused by difference between the coefficient of thermal expansion of said monolithic catalyst body and the coefficient of thermal expansion of said casing of said monolithic catalytic converter. Thus, the monolithic catalyst body is enabled to have a long service life, and difficulties in the prior art associated with the use of a ceramic monolithic catalyst body, which is inevitably brittle and fragile, are effectively obviated. Also the monolithic catalyst body is prevented from becoming loosened within the tubular casing of the monolithic catalytic converter, which guards against premature failure of said monolithic catalyst body and of the monolithic catalytic converter as a whole.

Further, according to the construction according to the present invention described above, it is possible to manufacture said one of said retainer rings out of strip or bank material stock, such as strip or band stainless steel stock, which is a great advantage as compared to the prior art constructional methods described above in which the retainer rings needed to the cut from stainless steel plate or the like; the possibility of using band of strip stock, which has become opened due to the construction of said one of said retainer rings as an open annulus with a gap rather than as a closed annulus as in the prior art, means that the efficiency of utilization of raw materials can be brought close to 100%. Thus waste of raw materials is avoided, and this is ecologically sound, as well as promoting cheapness of manufacture and economical production of a finished product. Yet further, the utilization of band or strip stock for producing said one of said retainer rings makes for ease of manufacture. Finally, the reliability of the monolithic catalytic converter which is provided by this good thermally stable supporting of the monolithic catalyst body in the casing thereof makes for good drivability of a vehicle which incorporates said monolithic catalytic converter.

Further, according to a particular aspect of the present invention, these and other objects are more particularly and concretely accomplished by a monolithic catalytic converter as described above, wherein said one of said retainer rings is cut away square at its said two free ends; and wherein said two free ends of said one of said retainer rings, when said one of said retainer rings is in the cold condition, oppose one another with a certain gap being left therebetween.

According to such a structure, said one of said retainer rings is particular simple to manufacture, since such a square cut away structure is easily machined. Accordingly, the advantages of the present invention relating to cheapness and manufacturability are particularly well realized. On the other hand, the sligt gap present between said two free ends of said one of said retainer rings does allow a slight part of said cushion ring associated with said one of said retainer rings to receive the impact of hot exhaust gases, especially before the monolithic catalytic converter has fully warmed up; but this may not in practice cause particular difficulties, depending upon circumstances.

Further, according to an aspect of the present invention which can be applied to any of the particular possibilities therefor, these and other objects are more particularly and concretely accomplished by a monolithic catalytic converter of any of the sorts described above, wherein said one of said retainer rings is formed with a flat first portion which is formed generally as a flat annulus extending generally in the radial direction, and a tubular second portion which is formed generally as a tubular annulus extending generally in the axial direction, with the periphery of one end of said tubular second portion connected to the radially inner periphery of said first flat portion; and wherein the cushion ring associated with said one of said retainer rings is of annular form, and is slipped over said tubular second portion of said one of said retainer rings and fits snugly thereover, with the radially inner face of said annular cushion ring resting against the radially outer face of said tubular second portion of said one of said retainer rings, and with the face of said annular cushion ring which axially faces away from said monolithic catalyst body in contact with the face of said first flat portion of said one of said retainer rings which axially faces towards said monolithic catalyst body.

According to such a structure, with said one of said retainer rings being made up of said first flat portion and of sad tubular second portion, with said one of said cushion rings associated therewith being slipped over said tubular second portion thereof, said one of said cushion rings is particularly well held by said one of said retainer rings and is very well and positively prevented from slipping out of place. This further helps to ensure that leakage of hot exhaust gases within the monolithic catalytic converter is effectively prevented, and thus the cushion rings and the radial bracing means for the monolithic catalyst body (if such there be) are further positively prevented from being exposed to the deleterious action of the hot exhaust gases flowing within the monolithic catalytic converter, and are accordingly prevented from being distorted and damaged, and from losing their elasticity.

Further, according to another particular aspect of the present invention, these and other objects are more particularly and concretely accomplished by a monolithic catalytic converter of the sort first described above, wherein said two free ends of said one of said retainer rings, when said one of said retainer rings is in the cold condition overlap one another; and wherein said one of said retainer rings is formed with a flat first portion which is formed generally as a flat annulus extending generally in the radial direction, and a tubular second portion which is formed generally as a tubular annulus extending generally in the axial direction, with the periphery of one end of said tubular second portion connected to the radially inner periphery of said first flat portion; and wherein the cushion ring associated with said one of said retainer rings is of annular form, and is slipped over said tubular second portion of said one of said retainer rings and fits snugly thereover, with the radially inner face of said annular cushion ring resting against the radially outer face of said tubular second portion of said one of said retainer rings, and with the face of said annular cushion ring which axially faces away from said monolithic catalyst body in contact with the face of said first flat portion of said one of said retainer rings which axially faces towards said monolithic catalyst body; when said one of said retainer rings is in the cold condition, the part of said flat first portion of said one of said retainer rings which is at one of said free ends thereof being overlapped over the part of said flat first portion of said one of said retainer rings which is at the other of said free ends thereof, and the part of said tubular second portion of said one of said retainer rings which is at said one of said free ends thereof being overlapped over the part of said tubular second portion of said one of said retainer rings which is at the other of said free ends thereof; and wherein said part of said flat first portion of said one of said retainer rings which is at said one of said free ends thereof and said part of said flat first portion of said one of said retainer rings which is at the other of said free ends thereof, when said one of said retainer rings is in the cold condition, are in sliding contact with one another, and said part of said tubular second portion of said one of said retainer rings which is at said one of said free ends thereof and said part of said tubular second portion of said one of said retainer rings which is at the other of said free ends thereof are in sliding contact with one another; and wherein one of said part of said flat first portion of said one of said retainer rings which is at said one of said free ends thereof and said part of said flat first portion of said one of said retainer rings which is at the other of said free ends thereof is cranked sideways out of its plane, and wherein one of said part of said tubular second portion of said one of said retainer rings which is at said one of said free ends thereof and said part of said tubular second portion of said one of said retainer rings which is at the other of said free ends thereof are in sliding contact with one another is cranked sideways out of its plane; and optionally the amount of said cranking, in both cases, may be approximately the thickness of the material concerned.

According to such a structure, since both said part of said flat first portion of said one of said retainer rings which is at said one of said free ends thereof and said part of said flat first portion of said one of said retainer rings which is at the other of said free ends thereof and also said part of said tubular second portion of said one of said retainer rings which is at said one of said free ends thereof and said part of said tubular second portion of said one of said retainer rings which is at the other of said free ends thereof are overlapped over one another and are in sliding contact with one another, thereby no substantial gap at all exists whereby a slight part of said cushion ring associated with said one of said retainer rings may receive the impact of hot exhaust gases, even before the monolithic catalytic converter has fully warmed up; and accordingly the cushion rings and the radial bracing means for the monolithic catalyst body (if such there be) are further positively prevented from being exposed to the deleterious action of the hot exhaust gases flowing within the monolithic catalytic converter, and are accordingly prevented from being distorted and damaged, and from losing their elasticity. Thus the durability of the monolithic catalytic converter is further promoted. However, this particular construction is somewhat harder to manufacture than is the construction detailed above; but this may not in practice cause particular difficulties, depending upon circumstances.

Further, according to an alternative particular aspect of the present invention, these and other objects are more particularly and concretely accomplished by a monolithic catalytic converter of the sort first described above, wherein said one of said retainer rings is formed with a flat first portion which is formed generally as a flat annulus extending generally in the radial direction, and a tubular second portion which is formed generally as a tubular annulus extending generally in the axial direction, with the periphery of one end of said tubular second portion connected to the radially inner periphery of said first flat portion; and wherein the cushion ring associated with said one of said retainer rings is of annular form, and is slipped over said tubular second portion of said one of said retainer rings and fits snugly thereover, with the radially inner face of said annular cushion ring resting against the radially outer face of said tubular second portion of said one of said retainer rings, and with the face of said annular cushion ring which axially faces away from said monolithic catalyst body in contact with the face of said first flat portion of said one of said retainer rings which axially faces towards said monolithic catalyst body; wherein the part of said tubular second portion of said one of said retainer rings which is at said one of said free ends thereof is, when said one of said retainer rings is in the cold condition, opposed to the part of said tubular second portion of said one of said retainer rings which is at the other of said free ends thereof with a certain gap being left therebetween; and wherein the part of said flat first portion of said one of said retainer rings which is at one of said free ends thereof and which is radially inward of a certain intermediate circumferentially extending line extends further in the circumferential direction towards said one free end of said one of said retainer rings than does the part of said flat first portion of said one of said retainer rings which is at said one of said free ends thereof and which is radially outward of said certain intermediate circumferentially extending line, while the part of said flat first portion of said one of said retainer rings which is at the other of said free ends thereof and which is radially inward of said certain intermediate circumferentially extending line extends less in the circumferential direction towards said one free end of said one of said retainer rings than does the part of said flat first portion of said one of said retainer rings which is at said other of said free ends thereof and which is radially outward of said certain intermediate circumferentially extending line; and optionally wherein said part of said flat first portion of said one of said retainer rings which is at said one of said free ends thereof and which is radially inward of said certain intermediate circumferentially extending line is connected along the circumferential direction to said part of said flat first portion of said one of said retainer rings which is at said one of said free ends thereof and which is radially outward of said certain intermediate circumferentially extending line by a first circumferentially extending surface, while the part of said flat first portion of said one of said retainer rings which is at the other of said free ends thereof and which is radially inward of said certain intermediate circumferentially extending line is connected along the circumferential direction to said part of said flat first portion of said one of said retainer rings which is at said other of said free ends thereof and which is radially outward of said certain intermediate circumferentially extending line by a second circumferentially extending surface; and optionally further wherein, when said one of said retainer rings is in the cold condition, said first and said second circumferentially extending surfaces are in contact with one another; and yet further optionally wherein said first and said second circumferentially extending surfaces are in sliding contact with one another.

According to such a structure, although a slight gap is present between the two ends of said tubular second portion of said one of said retainer rings, and although this slight gap may allow a slight part of said cushion ring associated with said one of said retainer rings to receive the impact of hot exhaust gases, especially before the monolithic catalytic converter has fully warmed up, nevertheless this may not in practice cause particular difficulties, depending upon circumstances. However, since the part of said flat first portion of said one of said retainer rings which is at said one of said free ends thereof and which is radially inward of said certain intermediate circumferentially extending line extends further in the circumferential direction towards said one free end of said one of said retainer rings than does the part of said flat first portion of said one of said retainer rings which is at said one of said free ends thereof and which is radially outward of said certain intermediate circumferentially extending line, while the part of said flat first portion of said one of said retainer rings which is at the other of said free ends thereof and which is radially inward of said certain intermediate circumferentially extending line extends less in the circumferential direction towards said one free end of said one of said retainer rings than does the part of said flat first portion of said one of said retainer rings which is at said other of said free ends thereof and which is radially outward of said certain intermediate circumferentially extending line, thereby no substantial gap at all through the plane of said first flat portion of said one of said retainer rings exists whereby said cushion ring associated with said one of said retainer rings may receive the impact of hot exhaust gases, even before the monolithic catalytic converter has fully warmed up. Accordingly the cushion rings and the radial bracing means for the monolithic catalyst body (if such there be) are quite well prevented from being exposed to the deleterious action of the hot exhaust gases flowing within the monolithic catalytic converter, although not quite so well as in the construction detailed proximately above, and are accordingly quite well prevented from being distorted and damaged, and from losing their elasticity. Thus the durability of the monolithic catalytic converter is promoted. Thus, it is seen that this this particular construction is of intermediate sealing effectiveness between that of the two constructions detailed above; and in view of the relative qualities of ease of construction and manufacture and so on this construction may in some circumstances be the most desirable one.

Further, in the optional case detailed above in which said part of said flat first portion of said one of said retainer rings which is at said one of said free ends thereof and which is radially inward of said certain intermediate circumferentially extending line is connected along the circumferential direction to said part of said flat first portion of said one of said retainer rings which is at said one of said free ends thereof and which is radially outward of said certain intermediate circumferentially extending line by a first circumferentially extending surface, while the part of said flat first portion of said one of said retainer rings which is at the other of said free ends thereof and which is radially inward of said certain intermediate circumferentially extending line is connected along the circumferential direction to said part of said flat first portion of said one of said retainer rings which is at said other of said free ends thereof and which is radially outward of said certain intermediate circumferentially extending line by a second circumferentially extending surface, and in which said first and said second circumferentially extending surfaces are in sliding contact with one another, the sealing effect of this sliding contact further ensures that no substantial gap at all through the plane of said first flat portion of said one of said retainer rings exists whereby said cushion ring associated with said one of said retainer rings may receive the impact of hot exhaust gases, even before the monolithic catalytic converter has fully warmed up.

Further, according to a particular aspect of the present invention, these and other objects are more particularly and concretely accomplished by a monolithic catalytic converter of the sort first detailed above, wherein, when said monolithic catalytic converter is operating to purify exhaust gases and is at steady operating temperature, the thermal expansion of said one of said retainer rings brings said break in the circumference of said one of said retainer rings to be substantially closed. Or, alternatively, these and other objects may be more particularly and concretely accomplished by a monolithic catalytic converter of the sort first detailed above, wherein, when said monolithic catalytic converter is operating to purify exhaust gases and is at steady operating temperature, the thermal expansion of said one of said retainer rings brings said two free square cut away ends of said one of said retainer rings substantially together. Or, alternatively, these and other objects may be more particularly and concretely accomplished by a monolithic catalytic converter of the sort first detailed above, wherein said two ends of said one of said retainer rings, when said one of said retainer rings is in the cold condition, oppose one another with a certain gap being left therebetween, and wherein, when said monolithic catalytic converter is operating to purify exhaust gases and is at steady operating temperature, said certain gap between said two free ends of said one of said retainer rings is substantially just closed up. Or, alternatively, these and other objects may be more particularly and concretely accomplished by a monolithic catalytic converter of the sort more proximately detailed above, wherein, when said monolithic catalytic converter is operating to purify exhaust gases and is at steady operating temperature, the end of the other one of said part of said flat first portion of said one of said retainer rings which is at said one of said free ends thereof and said part of said flat first portion of said one of said retainer rings which is at the other of said free ends thereof to the one of said parts which is cranked sideways out of its plane comes approximately just into contact with said one of said part of said flat first portion of said one of said retainer rings which is at said one of said free ends thereof and said part of said flat first portion of said one of said retainer rings which is at the other of said free ends thereof which is cranked sideways out of its plane, and wherein also the end of the other one of said part of said tubular second portion of said one of said retainer rings which is at said one of said free ends thereof and said part of said tubular second portion of said one of said retainer rings which is at the other of said free ends thereof to the one of said parts which is cranked sideways out of its plane comes approximately just into contact with said one of said part of said tubular second portion of said one of said retainer rings which is at said one of said free ends thereof and said part of said tubular second portion of said one of said retainer rings which is at the other of said free ends thereof which is cranked sideways out of its plane. Or, alternatively and finally, these and other objects may be more particularly and concretely accomplished by a monolithic catalytic converter of the sort most proximately detailed above, wherein, when said monolithic catalytic converter is operating to purify exhaust gases and is at steady operating temperature, said part of said flat first portion of said one of said retainer rings which is at one of said free ends thereof and which is radially inward of said certain intermediate circumferentially extending line comes approximately just into contact with said part of said flat first portion of said one of said retainer rings which is at the other of said free ends thereof and which is radially inward of said certain intermediate circumferentially extending line come, and also said part of said flat first portion of said one of said retainer rings which is at one of said free ends thereof and which is radially outward of said certain intermediate circumferentially extending line comes approximately just into contact with said part of said flat first portion of said one of said retainer rings which is at the other of said free ends thereof and which is radially outward of said certain intermediate circumferentially extending line.

According to such particular structures, the free play which is left available in said one of said retainer rings when the monolithic catalytic converter is in its cold condition is substantially all just taken up when the monolithic catalytic converter is in its operating condition of purifying exhaust gases which are passing through it and when said monolithic catalytic converter is heated up to substantially a steady operating temperature. Accordingly, since all such free play is substantially taken up, no substantial gap remains through which exhaust gases can play on or come into contact with either the cushion ring associated with said one of said retainer rings or the radial bracing means for the monolithic catalyst body; and accordingly said cushion ring and said radial bracing means for the monolithic catalyst body are even better prevented from being distorted and damaged, and from losing their elasticity, even over a long period of service. Accordingly, the reliability of the monolithic catalytic converter is advantageously promoted.

BRIEF DESCRIPTION OF THE DRAWINGS

The present invention will now be shown and described with reference to several preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DESCRIPTION OF THE PREFERRED EMBODIMENTS

Figure 1:
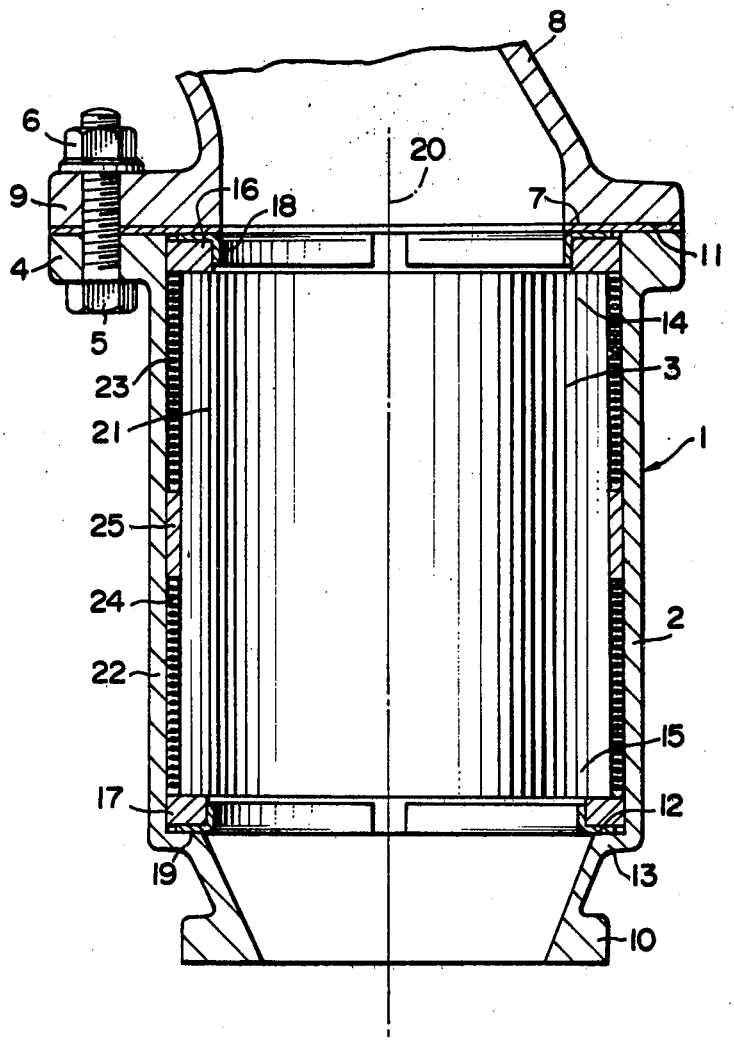
FIG. 1 is an axial sectional view taken through a monolithic catalytic converter according to the present invention, this figure being applicable to any of the three preferred embodiments of the monolithic catalytic converter according to the present invention which will hereinafter be described.

The present invention will now be described with reference to several preferred embodiments thereof, and with reference to the appended drawings. FIG. 1 is an axial sectional view of a monolithic catalytic converter according to the present invention, and this view can be applied to any one of the three preferred embodiments of the monolithic catalytic converter according to the present invention which will be described in detail shortly; FIG. 1 shows an overall view of the monolithic catalytic converter, which is designated by the reference numeral 1, and this monolithic catalytic converter 1 has a tubular casing 2 within which is received a monolithic catalyst body 3 which is of a cylindrical shape. Through holes formed in a flange 4 formed at the upper end in the figure of the tubular casing 2 of the monolithic catalytic converter 1 there pass a plurality of bolts 5 which have nuts 6 (only one of these nuts 6 and one of these bolts 5 can be seen in the figure) screwed onto their ends, and these bolts 5 also pass through corresponding holes formed in a flange 9 formed on the lower end in the figure of an exhaust manifold 8, which is only partially shown, and which is at its not shown end remote from the monolithic catalytic converter 1 fixed to an internal combustion engine (also not shown) of an automotive vehicle, said internal combustion engine, when it is operating, discharging its exhaust gases into said exhaust manifold 8. Thereby, the flange 4 of the tubular casing 2 of the monolithic catalytic converter 1 is fixedly attached to the flange 9 of the exhaust manifold 8, thus holding these two members together. A gasket 7 is interposed between the flange 4 of the tubular casing 2 of the monolithic catalytic converter 1 and the flange 9 of the exhaust menifold 8, for providing a good exhaust gas seal therebetween.

Within the tubular casing 2 of the monolithic catalytic converter 1 there is defined a cylindrical space, the upper end surface of which in the figure towards the exhaust manifold 8 is delimited by the lower side in the figure of the flanged portion 9 of said exhaust manifold 8, the lower end surface of which in the figure is defined by an annular shoulder portion 13 of the tubular casing 2, and the cylindrical side surface of which is delimited by a cylindrical side portion 22 of the tubular casing 2. This cylindrical space within the casing 2 receives the monolithic catalyst body 3, and via clamping means which will be explained shortly the monolithic catalyst body 3 is held as fixed in the axial direction is said cylindrical space between said flanged portion 9 of the exhaust manifold 8 and said stepped portion 13 of the casing 2. The lower end 10 in the figure of the tubular casing 2, below the stepped portion 13 thereof, is fixed to the upstream end of an exhaust pipe or the like, which is not shown in the figures, by means which are not particularly shown in the figures either. The monolithic catalyst body 3 is further supported in the radial direction within this cylindrical space within the tubular casing 2 by axially opposed tubular wire mesh portions 23 and 24 and by an intermediate tubular mass 25 formed from thermal foaming sealant, all of which are interposed between the outer cylindrical side surface of the monolithic catalyst body 3 and the inner cylindrical side surface of the aforesaid cylindrical side portion 22 of the tubular casing 2. According to this construction, when exhaust gases are expelled by the internal combustion engine (not shown) through the exhaust manifold 8 which receives said exhaust gases, these exhaust gases impinge upon the upper end in the figure of the monolithic catalyst body 3, pass downwards in the figure through the monolithic catalyst body 3, which is of a per se well known type, while being purified of noxious components such as CO, HC, and Nox, and pass out from the lower end in the figure of the monolithic catalyst body 3 to pass into the exhaust pipe (also not shown) connected to the lower end 10 of the tubular casing 2 of the monolithic catalytic converter 1.

The means for axially supporting the monolithic catalyst body 3 within the cylindrical space within the tubular casing 2, which is concerned in the crux of the present invention, will now be described.

Between the upper end 14 in the figure of the monolithic catalyst body 3 and the opposing flanged portion 9 of the exhaust manifold 8 there are interposed, in order from the monolithic catalyst body 3, a first cushion ring 16 and a first retainer ring 18. Further, between the lower end 15 in the figure of the monolithic catalyst body 3 and the opposing stepped portion 13 of the casing 2 there are likewise interposed, in order from the monolithic catalyst body 3, a second cushion ring 17 and a second retainer ring 19. The first cushion ring 16 and the second cushion ring 17 are substantially identical, and the first retainer ring 18 and the second retainer ring 19 are substantially identical; and hence only the constructional arrangements at the top end in the figure of the monolithic catalytic converter 1, involving the first cushion ring 16 and the first retainer ring 18, will be described, since the constructional arrangements at the bottom end in the figure of the monolithic catalytic converter 1, involving the second cushion ring 17 and the second retainer ring 19, are substantially the same. The first cushion ring 16 is formed as an annulus the cross section of which is substantially rectangular, and the face of said cushion ring 16 which axially faces the monolithic catalyst body 3 is in contact with the planar end of said monolithic catalyst body 3 at its radially outer part.

The first retainer ring 18 of the first preferred embodiment of the monolithic catalytic converter according to the present invention may be seen in an enlarged perspective view in FIG. 2; in fact, the view shown in FIG. 1 of the monolithic catalytic converter as a whole is applicable to all of the three preferred embodiments which will be described herein, as will be seen hereinafter. In the case of all the three preferred embodiments, the first retainer ring 18 is formed as an annulus the cross section of which is substantially shaped as a letter "L", in other words said first retainer ring 18 is formed with a flat first portion 26 which is formed generally as a flat annulus extending generally in the radial direction, and a tubular second portion 27 which is formed generally as a tubular annulus extending generally in the axial direction, with the periphery of one end of said tubular second portion 27 connected to the radially inner periphery of said first flat portion 26. The cushion ring 16 sits in the angle of the "L" shape of the first retainer ring 18; in other words, the cushion ring 16 is slipped over the aforesaid tubular second portion 27 of said retainer ring 18 and fits snugly thereover, with the radially inner face of the annular cushion ring 16 resting against the radially outer face of said tubular second portion 27 of said retainer ring 18, and with the face of said cushion ring 16 which axially faces away from the monolithic catalyst body 3 in contact with the face of said first flat portion 26 of said first retainer ring 18 which axially faces towards said monolithic catalyst body 3. And, of course, the face of said first flat portion 26 of said first retainer ring 18 which axially faces away from said monolithic catalyst body 3 is in contact with the opposing flanged portion 9 of the exhaust manifold 8, of course with the interposition of the gasket 7. Thus, the first retainer ring 18 and the first cushion ring 16 are axially squeezed between said flanged portion 9 of said exhaust manifold 8 and said upper portion 14 in the figure of said monolithic catalyst body 3. Similarly, the second retainer ring 19 and the second cushion ring 17 are axially squeezed between said stepped portion 13 of said casing 3 of said monolithic catalytic converter 1 and said lower portion 15 in the figure of said monolithic catalyst body 3; and thus by this structure the monolithic catalyst body 3 is securely clamped within the casing 3 of the monolithic catalytic converter 1 with regard to movement in the axial direction, and cannot substantially move therein, since of course a certain axial compressive force is present between said flanged portion 9 of said exhaust manifold 8, said first retainer ring 18, said first cushion ring 16, said monolithic catalyst body 3, said second cushion ring 17, said second retainer ring 19, and said stepped portion 13 of said casing 3 of said monolithic catalytic converter 1, in the specified order.

As described in the earlier portions of this specification, the present invention is particularly concerned with the arrangements for accomodating thermal expansion of the retainer rings 18 and 19, and these arrangements as far as the first preferred embodiment of the monolithic catalytic converter according to the present invention is concerned will now be explained, only discussing the upper or first retainer ring 18 as explained above and not the lower or second retainer ring 19, and with reference to FIG. 2, which is a perspective view thereof drawn on a larger scale than FIG. 1.

Figure 2:
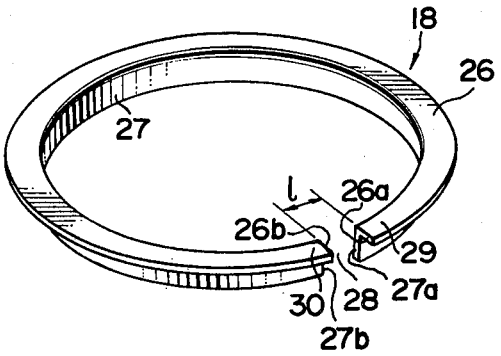
FIG. 2 is an enlarged perspective view of a retainer ring which is an important part of the first preferred embodiment of the monolithic catalytic converter according to the present invention which will be described, said retainer ring being shown in its cold condition.

In this first preferred embodiment, the first retainer ring 18 is divided at a portion of its circumference, a gap or cut away 28 being formed between the two respective right and left hand ends 29 and 30 of said first retainer ring 18, which oppose each other with a gap being left therebetween which is of a width, when the first retainer ring 18 is cold as in the view in FIG. 2, indicated by the reference symbol "1". The two opposing right and left hand ends 29 and 30 are, in this first preferred embodiment, cut away square, i.e. are cut along planes which contain the central axis of the first retainer ring 18 and which thus extend radially thereto, said planes being separated by an amount $1_1$; in other words, the two planes are separated at the radial distance from their line of intersection of the periphery of the first retainer ring 18, when the first retainer ring 18 is cold as in the view in FIG. 2, by a distance $1_1$. This gap or cut away 28 cannot be seen in the view of the first retainer ring 18 shown in FIG. 1, because it does not fall within the sectional plane of the monolithic catalytic converter 1 shown in that figure. The magnitude of the width "1" of the gap or cut away 28 of the first retainer ring 18 when said first retainer ring 18 is cold is so arranged that, when said first retainer ring 18 is heated up to a temperature typical of the temperatures that said first retainer ring 18 will encounter during service in the monolithic catalytic converter 1, the thermal expansion of said first retainer ring 18 causes said gap or cut away 28 to be substantially closed up, with its gap shrunk to substantially zero and with the right hand end 29 of the first retainer ring 18 substantially in contact with the left hand end 30 thereof. In other words, said distance "1" is set to be equal substantially to the amount of expansion of the circumference of said first retainer ring 18 between the cold condition and the working temperature condition thereof.

Now, in use, when the first retainer ring 18 is fitted to the monolithic catalytic converter 1 and when the monolithic catalytic converter 1 is first used in its cold and in its warming up conditions, with the internal combustion engine, not shown, expelling gases into the exhaust manifold 8 and through the monolithic catalyst body 3 of the monolithic catalytic converter 1 so that they enter into the exhaust pipe, not shown, connected to the lower end of the monolithic catalytic converter 1 in FIG. 1, then although there is a certain gap of width "1" or less still remaining between the opposing square cut ends 29 and 30 of the first retainer ring 18, and although therefore a small opening exists at this time whereby exhaust gases can pass in the radial direction of the first retainer ring 18, both in the plane of the flat first portion 26 thereof between the opposing ends 26*a* and 26*b* of this flat first portion 26, and also through the cylindrical shell of the second tubular portion 27 thereof between the opposing ends 27*a* and 27*b* of this second tubular portion 27, nevertheless the existence of this opening does not in practice cause any great difficulties, because in fact the escape of exhaust gases through the opening in the cylindrical shell of the second tubular portion 27 of said first retainer ring 18 between the opposing ends 27*a* and 27*b* of said second tubular portion 27 is prevented by the fact that the first cushion ring 16 intercepts such gas flow, and by the fact that the escape of exhaust gases through the opening in the plane of the flat first portion 26 of said first retainer ring 18 between the opposing ends 26*a* and 26*b* of said flat first portion 26 does not in practice occur to a significant extent, due to the fact that such escaped exhaust gases are intercepted by the gasket 17 and/or the tubular casing 2 of the monolithic catalytic converter 1, as may be understood from FIG. 1.

On the other hand, when the monolithic catalytic converter 1 is being used in its fully warmed up condition, then the gap remaining between the opposing square cut ends 29 and 30 of the first retainer ring 18 will be reduced to substantially zero as explained above, and therefore no opening will exist whereby exhaust gages can pass in the radial direction of the first retainer ring 18, and therefore the construction of the monolithic catalytic converter 1 in the warmed up operational condition provides good gas tightness. At the same time, the problems outlined before with relation to the prior art, in that the thermal expansion of the retainer ring caused undue stress to be set up therein which could lead to kinking and waviness thereof, which damaged the structure of the monolithic catalytic converter and which could lead to leakage and even to permanent failure thereof, are avoided, due to this provision of a thermal expansion capability for the first retainer ring 18.

In other words, the stress which would otherwise be set up in said retainer ring 18, if the expansion (and also particularly the differential expansion between the inner portions and the outer portions) in the circumferential length thereof were not thus relieved and if said retainer ring 18 was prevented from such substantially free expansion, is avoided; and hence waviness and kinking of said retainer ring 18, when it is hot, are substantially prevented from occurring. This means that leakage of hot exhaust gases within the monolithic catalytic converter 1 is effectively prevented, and thus the cushion ring 16 and the radial bracing means including the elements 23 and 25 for the monolithic catalyst body 3 are prevented from being exposed to the deleterious action of the hot exhaust gases flowing within the monolithic catalytic converter 1, and are accordingly prevented from being distorted and damaged, and from losing their elasticity. Thus, the cushion ring 16 is kept in its proper shape, and is prevented from slipping out of its proper position within the casing 2 of the monolithic catalytic converter 1 as bracing the monolithic catalyst body 3 therein. Thereby, the monolithic catalyst body 3 is securely and reliably held in place within said casing 2 of the monolithic catalytic converter 1, even after a long period of service, and is properly protected against damage due to shock and vibration, and also against the effects of differential expansion caused by difference between the coefficient of thermal expansion of said monolithic catalyst body 3 and the coefficient of thermal expansion of said casing of said monolithic catalytic converter 1. Thus, the monolithic catalyst body 3 is enabled to have a long service life, and difficulties in the prior art associated with the use of a ceramic monolithic catalyst body 3, which is inevitably brittle and fragile, are effectively obviated. Also the monolithic catalyst body 3 is prevented from becoming loosened within the tubular casing 2 of the monolithic catalytic converter 1, which guards against premature failure of said monolithic catalyst body 3 and of the monolithic catalytic converter 1 as a whole.

Further, according to the construction according to the present invention described above, it is possible to manufacture said retainer ring 18 out of strip or bank material stock, such as strip or band stainless steel stock, which is a great advantage as compared to the prior art constructional methods described above in which the retainer rings needed to be cut from stainless steel plate or the like; the possibility of using band of strip stock, which has become available due to the construction of said retainer ring 18 as an open annulus with a gap rather than as a closed annulus as in the prior art, means that the efficiency of utilization of raw materials can be brought very high, close even to 100%. Thus waste of raw materials is avoided, and this is ecologically sound, as well as promoting cheapness of manufacture and economical production of a finished product. Yet further, the utilization of band or strip stock for producing said retainer ring 18 makes for ease of manufacture. Finally, the reliability of the monolithic catalytic converter 1 which is provided by this good thermally stable supporting of the monolithic catalyst body 3 in the casing 2 of said monolithic catalytic converter 1 makes for good drivability of a vehicle which incorporates said monolithic catalytic converter 1.

Figure 3:
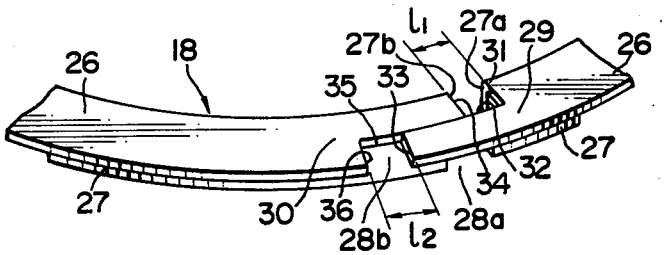
FIG. 3 is similar to FIG. 2, and is an enlarged perspective view of a corresponding retainer ring which is incorporated in the second preferred embodiment of the monolithic catalytic converter according to the present invention which will be described, said retainer ring also being shown in its cold condition.

In FIG. 3, there is shown an enlarged perspective view of a corresponding retainer ring 18 which is incorporated in the second preferred embodiment of the monolithic catalytic converter according to the present invention, said retainer ring 18 being shown in the cold condition, in a fashion similar to FIG. 2. In FIG. 3, parts and gaps of this retainer ring 18 of the second preferred embodiment shown, which correspond to parts and gaps of the retainer ring 18 of the first preferred embodiment shown in FIG. 2, and which have the same functions, are designated by the same reference numerals and/or symbols as in that figure; and also two measurements shown in FIG. 3 which functionally correspond to a measurement "1" shown in FIG. 2 are designated by reference symbols incorporating the symbol "1", by analogy with that figure.

In this second preferred embodiment of the monolithic catalytic converter according to the present invention, the general construction as it is seen in the sectional view of FIG. 1 is the same as in the case of the first preferred embodiment. Further, the first and second retainer rings 18 and 19 are again each formed with a flat first portion 26 which is generally shaped as a flat annulus extending generally in the radial direction, and a tubular second portion 27 which is generally shaped as a tubular annulus extending generally in the axial direction, with the periphery of one end of said tubular second portion 27 connected to the radially inner periphery of said first flat portion 26. Again, the cushion ring 16 sits in the angle of the "L" shape of the first retainer ring 18; in other words, the cushion ring 16 is again slipped over the aforesaid tubular second portion 27 of said retainer ring 18 and fits snugly thereover, with the radially inner face of the annular cushion ring 16 resting against the radially outer face of said tubular second portion 27 of said retainer ring 18, and with the face of said cushion ring 16 which axially faces away from the monolithic catalyst body 3 in contact with the face of said first flat portion 26 of said first retainer ring 18 which axially faces towards said monolithic catalyst body 3. And, of course, again, the face of said first flat portion 26 of said first retainer ring 18 which axially faces away from said monolithic catalyst body 3 is in contact with the opposing flanged portion 9 of the exhaust manifold 8, of course again with the interposition of the gasket 7. Thus, the first retainer ring 18 and the first cushion ring 16 are again axially squeezed between said flanged portion 9 of said exhaust manifold 8 and said upper portion 14 in the figure of said monolithic catalyst body 3. Similarly, the second retainer ring 19 and the second cushion ring 17 are again axially squeezed between said stepped portion 13 of said casing 3 of said monolithic catalytic converter 1 and said lower portion 15 in the figure of said monolithic catalyst body 3; and thus by this structure the monolithic catalyst body 3 is as before securely clamped within the casing 3 of the monolithic catalytic converter 1 with regard to movement in the axial direction, and cannot substantially move therein. The arrangements for accomodating thermal expansion of the first retainer ring 18, in this second preferred embodiment of the monolithic catalytic converter according to the present invention, will now be explained.

In this second preferred embodiment, the first retainer ring 18 is again divided at a portion of its circumference. Again, the gap or cut away cannot be seen in the view of the first retainer ring 18 shown in FIG. 1, because it does not fall within the sectional plane of the monolithic catalytic converter 1 shown in that figure, which as stated above applies to this second preferred embodiment as well as to the first preferred embodiment described above. However, the gap or cut away which is formed, which again is denoted by the reference numeral 28, is not square cut as was the case in the first preferred embodiment. Instead, the cylindrical shell of the second tubular portion 27 of said first retainer ring 18 and also the radially inner part of said flat first portion 26 of said first retainer ring 18 are both cut away along the same two planes, said planes containing the axis of the first retainer ring 18 and thus extending in its radial direction, by an amount "$1_1$" (i.e., the two planes are separated at the radial distance from their line of intersection of the periphery of the first retainer ring 18, when the first retainer ring 18 is cold as in the view in FIG. 3, by a distance "$1_1$"), so as to leave a gap 28*a* of width "$1_1$" between the opposing respective right and left hand ends 27*a* and 27*b* of said second tubular portion 27 and the opposing respective right and left hand ends 31 and 34 of said radially inner part of said flat first portion 26; and further the radially outer part of said flat first portion 26 of said first retainer ring 18 is cut away along another two planes, said other two planes containing the axis of the first retainer ring 18 and thus extending in its radial direction, by an amount "$1_2$" (i.e., said other two planes are separated at the radial distance from their line of intersection of the periphery of the first retainer ring 18, when the first retainer ring 18 is cold as in the view in FIG. 3, by a distance "$1_2$"), so as to leave a gap 28*b* of width "$1_2$" between the opposing respective right and left hand ends 33 and 36 of said radially outer part of said flat first portion 26. This gap 28*b* between the opposing right and left hand ends 33 and 36 of said radially outer part of said flat first portion 26 is somewhat circumferentially displaced or offset from the gap 28*a* between the opposing right and left hand ends 27*a* and 27*b* of said second tubular portion 27 and the opposing right and left hand ends 31 and 34 of said radially inner part of said flat first portion 26; and accordingly the one right hand end 31 of the radially inner part of said flat first portion 26 is connected to the corresponding right hand end 33 of the radially outer part of said flat first portion 26 by an outer cylindrical surface 32 which extends generally perpendicular to the plane of the first retainer ring 18 in the circumferential direction of said first retainer ring 18, and also the other left hand end 34 of the radially inner part of said flat first portion 26 is connected to the corresponding left hand end 36 of the radially outer part of said flat first portion 26 by another inner cylindrical surface 35 which extends generally perpendicular to the plane of the first retainer ring 18 in the circumferential direction of said first retainer ring 18. And, as the first retainer ring 18 is expanded or is contracted in the circumferential direction, either by for example squeezing or by the expanding and contracting effects of changes of temperature, the two cylindrical surfaces 32 and 35 slide on one another in a mutually contacting manner, with the inner cylindrical surface 35 located on the radially inward side of the outer cylindrical surface 32, as the two opposing left and right hand ends of the first retainer ring 18 are moved towards and away from one another. The magnitude of the width "$1_1$" of the gap or cut away 28*a* between the opposing right and left hand ends 27*a* and 27*b* of said second tubular portion 27 and the opposing right and left hand ends 31 and 34 of said radially inner part of said flat first portion 26 of the first retainer ring 18, and the magnitude of the width "$1_2$" of the gap or cut away 28*b* between the opposing respective right and left hand ends 33 and 36 of said radially outer part of said flat first portion 26, when said first retainer ring 18 is cold, are so arranged that, when said first retainer ring 18 is heated up to a temperature typical of the temperatures that said first retainer ring 18 will encounter during service in the monolithic catalytic converter 1, the thermal expansion of said first retainer ring 18 causes said gaps or cut aways 28*a* and 28*b* to be substantially closed up, with their gaps shrunk to substantially zero. In other words, said distance "$1_1$" is set to be equal substantially to the amount of expansion of the circumferentially inner part of said first retainer ring 18 between the cold condition and the working temperature condition thereof, and said distance "$1_2$" is set to be equal substantially to the amount of expansion of the circumferentially outer part of said first retainer ring 18 between the cold condition and the working temperature condition thereof.

Now, in use, when the first retainer ring 18 is fitted to the monolithic catalytic converter 1 and when the monolithic catalytic converter 1 is first used in its cold and in its warming up conditions, with the internal combustion engine, not shown, expelling gases into the exhaust manifold 8 and through the monolithic catalyst body 3 of the monolithic catalytic converter 1 so that they enter into the exhaust pipe, not shown, connected to the lower end of the monolithic catalytic converter 1 in FIG. 1, then although there is a certain gap of width "$1_1$" or less still remaining between the opposing right and left hand ends 27*a* and 27*b* of the second tubular portion 27 of said first retainer ring 18, and although therefore a small opening exists at this time whereby exhaust gases can pass in the radial direction of the first retainer ring 18 through the cylindrical shell of the second tubular portion 27 thereof between the opposing ends 27*a* and 27*b* of this second tubular portion 27, but as before the existence of this opening does not in practice cause any great difficulties, because in fact, as before, the escape of exhaust gases through the opening in the cylindrical shell of the second tubular portion 27 of said first retainer ring 18 between the opposing ends 27*a* and 27*b* of said second tubular portion 27 is prevented by the fact that the first cushion ring 16 intercepts such gas flow. Further, although there is a certain gap of width "$1_1$" or less still remaining between the opposing right and left hand ends 31 and 34 of said radially inner part of said flat first portion 26, and although there is a certain gap of width "$1_2$" or less still remaining between the opposing respective right and left hand ends 33 and 36 of said radially outer part of said flat first portion 26, in fact the escape of exhaust gases through these openings in the plane of the flat first portion 26 of said first retainer ring 18 between the opposing ends of the flat portion 26 of said first retainer ring 18, in the case of this second preferred embodiment of the monolithic catalytic converter according to the present invention, in contrast to what was the case with the first preferred embodiment described above and shown in detail in FIG. 2, cannot occur to any substantial amount, due to the fact that the contact between the inner cylindrical circumferentially extending surface 35 and the outer cylindrical circumferentially extending surface 32 directly intercepts such flow of escaped exhaust gases, before in any case such flow of escaped exhaust gases should be intercepted by the gasket 17 and/or the tubular casing 2 of the monolithic catalytic converter 1, as was the case in the first preferred embodiment of the monolithic catalytic converter according to the present invention, as may be understood from FIG. 1.

On the other hand, when the monolithic catalytic converter 1 is being used in its fully warmed up condition, then the gap which in the cold condition was of width "$1_1$" between the opposing right and left hand ends *27a* and *27b* of the second tubular portion 27 of said first retainer ring 18, the gap which in the cold condition was of width "$1_1$" between the opposing right and left hand ends 31 and 24 of the radially inner part of the flat first portion 26 of said first retainer ring 18, and the gap which in the cold condition was of width "$1_2$" between the opposing respective right and left hand ends 33 and 36 of the radially outer part of said flat first portion 26 of said first retainer ring 18 will be reduced to substantially zero as explained above, and therefore no substantial opening will exist whereby exhaust gases can pass in the radial direction of the first retainer ring 18, and therefore the construction of the shown second preferred embodiment of the monolithic catalytic converter 1 in the warmed up operational condition provides good gas tightness. At the same time, the problems outlined before with relation to the prior art, in that the thermal expansion of the retainer ring caused undue stress to be set up therein which could lead to kinking and waviness thereof, which damaged the structure of the monolithic catalytic converter and which could lead to leakage and even to permanent failure thereof, are avoided, due to this provision of a thermal expansion capability for the first retainer ring 18.

Thus, according to such a structure, although a slight gap is present between the two ends of said tubular second portion 27 of said retainer ring 18, and although this slight gap may allow a slight part of said cushion ring 16 associated with said retainer ring 18 to receive the impact of hot exhaust gases, especially before the monolithic catalytic converter 1 has fully warmed up, nevertheless this may not in practice cause particular difficulties, depending upon circumstances. However, since the part of said flat first portion 26 of said retainer ring 18 which is at the left hand one 30 of said free ends thereof and which is radially inward of the intermediate circumferentially extending line thereon extends further in the circumferential direction towards said one left hand end 30 of said retainer ring 18 than does the part of said flat first portion 26 of said retainer ring 18 which is at said free end 30 thereof and which is radially outward of said intermediate circumferentially extending line thereon, while the part of said flat first portion 26 of said retainer ring 18 which is at the other right hand free end 29 thereof and which is radially inward of said intermediate circumferentially extending line thereon extends less in the circumferential direction towards said other free end 29 of said retainer ring 18 than does the part of said flat first portion 26 of said retainer ring 18 which is at said other one 29 of said free ends thereof and which is radially outward of said intermediate circumferentially extending line thereon, thereby no substantial gap at all through the plane of said first flat portion 26 of said retainer ring 18 exists whereby said cushion ring 16 associated with said retainer ring 18 may receive the impact of hot exhaust gases, even before the monolithic catalytic converter 1 has fully warmed up. Accordingly the cushion ring 16 and the radial bracing means for the monolithic catalyst body 1 including the means 23 and 25 are quite well prevented from being exposed to the deleterious action of the hot exhaust gases flowing within the monolithic catalytic converter 1, and are accordingly quite well prevented from being distorted and damaged, and from losing their elasticity. Thus the durability of the monolithic catalytic converter 1 is promoted. Thus, it is seen that this particular construction is of better sealing effectiveness than that of the first preferred embodiment of the monolithic catalytic converter according to the present invention detailed above; and in view of the relative qualities of ease of construction and manufacture and so on this second preferred embodiment may in some circumstances be the most desirable one.

Further, since the circumferentially extending surfaces 32 and 35 are in sliding contact with one another, the sealing effect of this sliding contact further ensures that no substantial gap at all through the plane of said first flat portion 26 of said retainer ring 18 exists whereby said cushion ring 16 associated with said retainer ring 18 may receive the impact of hot exhaust gases, even before the monolithic catalytic converter 1 has fully warmed up.

Figure 4:
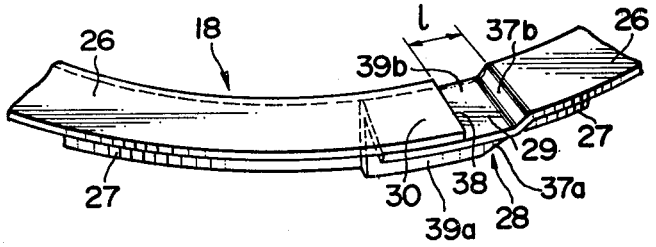
FIG. 4 is similar to FIGS. 2 and 3, and is an enlarged perspective view of a corresponding retainer ring which is incorporated in the third preferred embodiment of the monolithic catalytic converter according to the present invention which will be described, said retainer ring also being shown in its cold condition.

In FIG. 4, there is shown an enlarged perspective view of a corresponding retainer ring 18 which is incorporated in the third preferred embodiment of the monolithic catalytic converter according to the present invention, said retainer ring 18 being shown in the cold condition, in a fashion similar to FIG. 2 and FIG. 3. In FIG. 4, parts and gaps of the retainer ring 18 of the third preferred embodiment shown, which correspond to parts and gaps of the retainer rings 18 of the first and second preferred embodiments shown in FIG. 2 and in FIG. 3, and which have the same functions, are designated by the same reference numerals and/or symbols as in those figures; and also a measurement shown in FIG. 4 which corresponds to a measurement "1" shown in FIG. 2 and to measurements "$1_1$" and "$1_2$" shown in FIG. 3 is again designated by the reference symbol "1", as in FIG. 2.

In this third preferred embodiment of the monolithic catalytic converter according to the present invention, the general construction as it is seen in the sectional view of FIG. 1 is the same as in the case of the first preferred embodiment and the second preferred embodiment. Further, the first and second retainer rings 18 and 19 are again each formed with a flat first portion 26 which is generally shaped as a flat annulus extending generally in the radial direction, and a tubular second portion 27 which is generally shaped as a tubular annulus extending generally in the axial direction, with the periphery of one end of said tubular second portion 27 connected to the radially inner periphery of said first flat portion 26. Again, the cushion ring 16 sits in the angle of the "L" shape of the first retainer ring 18; in other words, the cushion ring 16 is again slipped over the aforesaid tubular second portion 27 of said retainer ring 18 and fits snugly thereover, with the radially inner face of the annular cushion ring 16 resting against the radially outer face of said tubular second portion 27 of said retainer ring 18, and with the face of said cushion ring 16 which axially faces away from the monolithic catalyst body 3 in contact with the face of said first flat portion 26 of said first retainer ring 18 which axially faces towards said monolithic catalyst body 3. And, of course, again, the face of said first flat portion 26 of said first retainer ring 18 which axially faces away from said monolithic catalyst body 3 is in contact with the opposing flanged portion 9 of the exhaust manifold 8, of course again with the interposition of the gasket 7. Thus, the first retainer ring 18 and the first cushion ring 16 are again axially squeezed between said flanged portion 9 of said exhaust manifold 8 and said upper portion 14 in the figure of said monolithic catalyst body 3. Similarly, the second retainer ring 19 and the second cushion ring 17 are again axially squeezed between said stepped portion 13 of said casing 3 of said monolithic catalytic converter 1 and said lower portion 15 in the figure of said monolithic catalyst body 3; and thus by this structure the monolithic catalyst body 3 is as before securely clamped within the casing 3 of the monolithic catalytic converter 1 with regard to movement in the axial direction, and cannot substantially move therein. The arrangements for accomodating thermal expansion of the first retainer ring 18, in this third preferred embodiment of the monolithic catalytic converter according to the present invention, will now be explained.

In this third preferred embodiment, the first retainer ring 18 is again divided at a portion of its circumference. Again, the gap or cut away cannot be seen in the view of the first retainer ring 18 shown in FIG. 1, because it does not fall within the sectional plane of the monolithic catalytic converter 1 shown in that figure, which as stated above also applies to this third preferred embodiment, as well as to the first and second preferred embodiments described above. However, the gap or cut away which is formed, which again is denoted by the reference numeral 28, is not square cut as was the case in the first preferred embodiment, and is not step cut as was the case in the second preferred embodiment. Instead, the part 39*a* of the cylindrical shell of the second tubular portion 27 of said first retainer ring 18 near the right hand end 29 of said first retainer ring 18 and also the part 39*b* of said flat first portion 26 of said first retainer ring 18 near the right hand end 29 of said first retainer ring 18 are both stepped or cranked towards their sides on the inside of the angle of the "L" shape of the cross section of the first retainer ring 18 in directions perpendicular to their local planes, these steps or cranks being at approximately the same circumferential position on the first retainer ring 18 and being denoted by the reference numerals 37*a* and 37*b* respectively in FIG. 4. And each of these cranked portions 39*a* and 39*b* is stepped or cranked out of its plane at its respective step or crank 37*a* or 37*b* by an amount approximately equal to the thickness of the metal which composes it. Thus, the right hand end portion 29 of the first retainer ring 18 rests against the side of the left hand end portion 30 of said first retainer ring 18 which is towards the inside of the angle of the "L" shape of the cross section thereof, without substantially stressing the first retainer ring 18 at all. A gap 28 of width "1", when the first retainer ring 18 is cold as in the view in FIG. 3, is left between the opposing left hand end surface, denoted in the figure by the reference numeral 38, of the left hand end 30 of said first retainer ring 18 and these opposing cranks 37*a* and 37*b* of the second tubular portion 27 and of the first flat portion 26 of the first retainer ring 18. Thus, as the first retainer ring 18 is expanded or is contracted in the circumferential direction, either by for example squeezing or by the expanding and contracting effects of changes of temperature, the surfaces of the cranked portions 39*a* and 39*b* of the right hand end portion of the tubular second portion 27 and of the right hand end portion of the flat first portion 26 of the first retainer ring 18 which are on the outside of the "L" cross sectional shape of said first retainer ring 18 slide respectively on the surface of the left hand end portion of the tubular second portion 27 and on the surface of the left hand end portion of the flat first portion 26 of the first retainer ring 18 which are on the inside of the "L" cross sectional shape of said first retainer ring 18 in a mutually contacting manner, with the side of the right hand end portion 29 of the first retainer ring 18 which is towards the outside of the angle of the "L" shape of the cross section thereof thus resting against and sliding on the side of the left hand end portion 30 of said first retainer ring 18 which is towards the inside of the angle of the "L" shape of the cross section thereof, as the two opposing right and left hand ends 29 and 30 of the first retainer ring 18 are moved towards and away from one another. The magnitude of the width "1" of the gap 28 between the opposing left hand end surface 38 of the left hand end 30 of said first retainer ring 18 and the opposing cranks 37*a* and 37*b* of the second tubular portion 27 and of the first flat portion 26 of the first retainer ring 18, when said first retainer ring 18 is cold, is so arranged that, when said first retainer ring 18 is heated up to a temperature typical of the temperatures that said first retainer ring 18 will encounter during service in the monolithic catalytic converter 1, the thermal expansion of said first retainer ring 18 causes said gap 28 to be substantially closed up, with its width shrunk to substantially zero. In other words, said distance "1" is set to be equal substantially to the amount of expansion of said first retainer ring 18 between the cold condition and the working temperature condition thereof.

Now, in use, when the first retainer ring 18 is fitted to the monolithic catalytic converter 1 and when the monolithic catalytic converter 1 is first used in its cold and in its warming up conditions, with the internal combustion engine, not shown, expelling gases into the exhaust manifold 8 and through the monolithic catalyst body 3 of the monolithic catalytic converter 1 so that they enter into the exhaust pipe, not shown, connected to the lower end of the monolithic catalytic converter 1 in FIG. 1, then although there is a certain gap of width "1" or less still remaining between the opposing left hand end surface 38 of the left hand end 30 of said first retainer ring 18 and both of the opposing cranks 37*a* and 37*b* of the second tubular portion 27 and of the first flat portion 26 of the first retainer ring 18, nevertheless no particular opening exists at this time whereby exhaust gases can pass in the radial direction of the first retainer ring 18 through the cylindrical shell of the second tubular portion 27 thereof or through the flat radially extending plane of the first flat portion 26, because not only is the upper surface in FIG. 4 of the right hand end portion of the first flat portion 26 of the first retainer ring 18 in sliding and substantially gas tight contact with the lower surface in FIG. 4 of the left hand end portion of said first flat portion 26, but also the surface away from the viewer from the point of view of FIG. 4 of the right hand end portion of the tubular second portion 27 of the first retainer ring 18, i.e. the radially inward surface thereof, is in sliding and substantially gas tight contact with the surface towards the viewer from the point of view of FIG. 4 of the left hand end portion of said tubular second portion 27 of the first retainer ring 18, i.e. the radially outward surface thereof; and thus the escape of exhaust gases through these two gaps of said first retainer ring 18 between the opposing left hand end surface 38 of the left hand end 30 of said first retainer ring 18 and the opposing cranks 37*a* and 37*b* of the second tubular portion 27 and of the first flat portion 26 of the first retainer ring 18, in the case of this third preferred embodiment of the monolithic catalytic converter according to the present invention, in contrast to what was the case with the first preferred embodiment described above and shown in detail in FIG. 2 and with the second preferred embodiment described above and shown in detail in FIG. 3, cannot occur to any substantial amount, due to the fact that the contact between the upper surface in FIG. 4 of the right hand end portion of the first flat portion 26 of the first retainer ring 18 and the lower surface in FIG. 4 of the left hand end portion of said first flat portion 26, and also the surface away from the viewer from the point of view of FIG. 4 of the right hand end portion of the tubular second portion 27 of the first retainer ring 18 and the surface towards the viewer from the point of view of FIG. 4 of the left hand end portion of said tubular second portion 27 of the first retainer ring 18 directly intercepts such flow of escaped exhaust gases, before in any case such flow of escaped exhaust gases should be intercepted by the cushion ring 16 or the gasket 17 and/or the tubular casing 2 of the monolithic catalytic converter 1, as was the case in the first preferred embodiment of the monolithic catalytic converter according to the present invention or the second preferred embodiment of the monolithic catalytic converter according to the present invention, as may be understood from FIG. 1.

On the other hand, when the monolithic catalytic converter 1 is being used in its fully warmed up condition, then the gap 28 which in the cold condition was of width "1" between the opposing left hand end surface 38 of the left hand end 30 of the first retainer ring 18 and the opposing cranks 37*a* and 37*b* of the second tubular portion 27 and of the first flat portion 26 of the first retainer ring 18 will be reduced to substantially zero as explained above, and therefore no substantial opening will exist whereby exhaust gases can pass in the radial direction of the first retainer ring 18, and therefore the construction of the shown third preferred embodiment of the monolithic catalytic converter 1 in the warmed up operational condition provides good gas tightness. At the same time, the problems outlined before with relation to the prior art, in that the thermal expansion of the retainer ring caused undue stress to be set up therein which could lead to kinking and waviness thereof, which damaged the structure of the monolithic catalytic converter and which could lead to leakage and even to permanent failure thereof, are avoided, due to this provision of a thermal expansion capability for the first retainer ring 18.

Thus, according to this third preferred embodiment of the monolithic catalytic converter according to the present invention, since both the part of the flat first portion 26 of said retainer ring 18 which is at said free end 29 thereof and the part of said flat first portion 26 of said retainer ring 18 which is at the other free end 30 thereof and also the part of the tubular second portion 27 of said retainer ring 18 which is at said one 29 of said free ends thereof and the part of said tubular second portion 27 of said retainer ring 18 which is at the other one 30 of said free ends thereof are overlapped over one another and are in sliding contact with one another, thereby no substantial gap at all exists whereby any slight part of said cushion ring 16 associated with said retainer ring 18 may receive the impact of hot exhaust gases, even before the monolithic catalytic converter 1 has fully warmed up; and accordingly the cushion ring 16 and the radial bracing means for the monolithic catalyst body including the means 23 and 25 are further positively prevented from being exposed to the deleterious action of the hot exhaust gases flowing within the monolithic catalytic converter 1, and are accordingly prevented from being distorted and damaged, and from losing their elasticity. Thus the durability of the monolithic catalytic converter 1 is further promoted. However, this third preferred embodiment of the monolithic catalytic converter according to the present invention may be somewhat harder to manufacture than are the first two embodiments detailed above; but this may not in practice cause particular difficulties, depending upon circumstances.

Although the present invention has been shown and described with reference to several preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiments, or of the drawings, but solely by the scope of the appended claims, which follow.

What is claimed is:

1. A monolithic catalytic converter, comprising:

a tubular casing which defines a cylindrical internal space therein and has first and second annular stepped portions which define first and second outer peripheral axial ends of said cylindrical internal space, respectively;

a monolithic catalyst body which is generally of a columnar shape and which has first and second axial ends;

first and second cushion rings, which are respectively engaged with said first and said second axial ends of said monolithic catalyst body; and first and second retainer rings, said first retainer ring being engaged with a side of said first cushion ring remote from said monolithic catalyst body and said second retainer ring being engaged with a side of said second cushion ring remote from said monolithic catalyst body, said first retainer ring being freely rotatable relative to, but axially supported by, said first stepped portion of said casing and abuttingly supporting said monolithic catalyst body via said first cushion ring, and said second retainer ring being freely rotatable relative to, but axially supported by, said second stepped portion of said casing and abuttingly supporting said monolithic catalyst body via said second cushion ring, at least one of said first and said second retainer rings being a substantially annular arcuate body with two opposite free ends thereof being arranged to be circumferentially movable relative to one another by at least such an amount accomodating circumferential thermal expansion of said retainer ring caused by a temperature rise thereof from a cold non-operating condition thereof to a hot operating condition thereof.

2. A monolithic catalytic converter according to claim 1, wherein said two free ends of said one of said retainer rings, when said one of said retainer rings is in the cold condition, overlap one another.

3. A monolithic catalytic converter according to claim 2, wherein said two overlapping free ends of said one of said retainer rings, when said one of said retainer rings is in the cold condition, are in sliding contact with one another.

4. A monolithic catalytic converter according to claim 2, wherein said one of said retainer rings is formed with a flat first portion which is formed generally as a flat annulus extending generally in the radial direction, and a tubular second portion which is formed generally as a tubular annulus extending generally in the axial direction, with the periphery of one end of said tubular second portion connected to the radially inner periphery of said first flat portion; and wherein the cushion ring associated with said one of said retainer rings is of annular form, and is slipped over said tubular second portion of said one of said retainer rings and fits snugly thereover, with the radially inner face of said annular cushion ring resting against the radially outer face of said tubular second portion of said one of said retainer rings, and with the face of said annular cushion ring which axially faces away from said monolithic catalyst body in contact with the face of said first flat portion of said one of said retainer rings which axially faces towards said monolithic catalyst body; when said one of said retainer rings is in the cold condition, the part of said flat first portion of said one of said retainer rings which is at one of said free ends thereof being overlapped over the part of said flat first portion of said one of said retainer rings which is at the other of said free ends thereof, and the part of said tubular second portion of said one of said retainer rings which is at said one of said free ends thereof being overlapped over the part of said tubular second portion of said one of said retainer rings which is at the other of said free ends thereof.

5. A monolithic catalyst converter according to claim 4, wherein said part of said flat first portion of said one of said retainer rings which is at said one of said free ends thereof and said part of said flat first portion of said one of said retainer rings which is at the other of said free ends thereof, when said one of said retainer rings is in the cold condition, are in sliding contact with one another, and said part of said tubular second portion of said one of said retainer rings which is at said one of said free ends thereof and said part of said tubular second portion of said one of said retainer rings which is at the other of said free ends thereof are in sliding contact with one another.

6. A monolithic catalytic converter according to claim 5, wherein one of said part of said flat first portion of said one of said retainer rings which is at said one of said free ends thereof and said part of said flat first portion of said one of said retainer rings which is at the other of said free ends thereof is cranked sideways out of its plane, and wherein one of said part of said tubular second portion of said one of said retainer rings which is at said one of said free ends thereof and said part of said tubular second portion of said one of said retainer rings which is at the other of said free ends thereof are in sliding contact with one another is cranked sideways out of its plane.

7. A monolithic catalytic converter according to claim 6, wherein the amount of said cranking, in both cases, is approximately the thickness of the material concerned.

8. A monolithic catalytic converter according to claim 1, wherein said one of said retainer rings is formed with a flat first portion which is formed generally as a flat annulus extending generally in the radial direction, and a tubular second portion which is formed generally as a tubular annulus extending generally in the axial direction, with the periphery of one end of said tubular second portion connected to the radially inner periphery of said first flat portion; and wherein the cushion ring associated with said one of said retainer rings is of annular form, and is slipped over said tubular second portion of said one of said retainer rings and fits snugly thereover, with the radially inner face of said annular cushion ring resting against the radially outer face of said tubular second portion of said one of said retainer rings, and with the face of said annular cushion ring which axially faces away from said monolithic catalyst body in contact with the face of said first flat portion of said one of said retainer rings which axially faces towards said monolithic catalyst body; wherein the part of said tubular second portion of said one of said retainer rings which is at said one of said free ends thereof is, when said one of said retainer rings is in the cold condition, opposed to the part of said tubular second portion of said one of said retainer rings which is at the other of said free ends thereof with a certain gap being left therebetween; and wherein the part of said flat first portion of said one of said retainer rings which is at one of said free ends thereof and which is radially inward of a certain intermediate circumferentially extending line extends further in the circumferential direction towards said one free end of said one of said retainer rings than does the part of said flat first portion of said one of said retainer rings which is at said one of said free ends thereof and which is radially outward of said certain intermediate circumferentially extending line, while the part of said flat first portion of said one of said retainer rings which is at the other of said free ends thereof and which is radially inward of said certain intermediate circumferentially extending line extends less in the circumferential direction towards said one free end of said one of said retainer rings than does the part of said flat first portion of said one of said retainer rings which is at said other of said free ends thereof and which is radially outward of said certain intermediate circumferentially extending line.

9. A monolithic catalytic converter according to claim 8, wherein said part of said flat first portion of said one of said retainer rings which is at said one of said free ends thereof and which is radially inward of said certain intermediate circumferentially extending line is connected along the circumferential direction to said part of said flat first portion of said one of said retainer rings which is at said one of said free ends thereof and which is radially outward of said certain intermediate circumferentially extending line by a first circumferentially extending surface, while the part of said flat first portion of said one of said retainer rings which is at the other of said free ends thereof and which is radially inward of said certain intermediate circumferentially extending line is connected along the circumferential direction to said part of said flat first portion of said one of said retainer rings which is at said other of said free ends thereof and which is radially outward of said certain intermediate circumferentially extending line by a second circumferentially extending surface.

10. A monolithic catalytic converter according to claim 9, wherein, when said one of said retainer rings is in the cold condition, said first and said second circumferentially extending surfaces are in contact with one another.

11. A monolithic catalytic converter according to claim 9, wherein said first and said second circumferentially extending surfaces are in sliding contact with one another.

12. A monolithic catalytic converter according to either one of claim 6 or claim 13, wherein, when said monolithic catalytic converter is operating to purify exhaust gases and is at steady operating temperature, the end of the other one of said part of said flat first portion of said one of said retainer rings which is at said one of said free ends thereof and said part of said flat first portion of said one of said retainer rings which is at the other of said free ends thereof to the one of said parts which is cranked sideways out of its plane comes approximately just into contact with said one of said part of said flat first portion of said one of said retainer rings which is at said one of said free ends thereof and said part of said flat first portion of said one of said retainer rings which is at the other of said free ends thereof which is cranked sideways out of its plane, and wherein also the end of the other one of said part of said tubular second portion of said one of said retainer rings which is at said one of said free ends thereof and said part of said tubular second portion of said one of said retainer rings which is at the other of said free ends thereof to the one of said parts which is cranked sideways out of its plane comes approximately just into contact with said one of said part of said tubular second portion of said one of said retainer rings which is at said one of said free ends thereof and said part of said tubular second portion of said one of said retainer rings which is at the other of said free ends thereof which is cranked sideways out of its plane.

13. A monolithic catalytic converter according to any one of claims 1 through 17, wherein, when said monolithic catalytic converter is operating to purify exhaust gases and is at steady operating temperature, said part of said flat first portion of said one of said retainer rings which is at one of said free ends thereof and which is radially inward of said certain intermediate circumferentially extending line comes approximately just into contact with said part of said flat first portion of said one of said retainer rings which is at the other of said free ends thereof and which is radially inward of said certain intermediate circumferentially extending line come, and also said part of said flat first portion of said one of said retainer rings which is at one of said free ends thereof and which is radially outward of said certain intermediate circumferentially extending line comes approximately just into contact with said part of said flat first portion of said one of said retainer rings which is at the other of said free ends thereof and which is radially outward of said certain intermediate circumferentially extending line.

14. A monolithic catalytic converter according to claim 1, wherein the two opposite free ends of said arcuate body circumferentially oppose one another with a gap left therebetween when said retainer ring is in the cold state, said gap being sized such that said gap is reduced substantially to zero when said retainer ring is warmed up to said hot operating condition.

15. A monolithic catalytic converter according to claim 1, wherein said arcuate body includes a flat arcuate portion and an axially slited substantially tubular portion, with the periphery of one axial end of said substantially tubular portion being connected to the radially inner periphery of said flat arcuate portion, and wherein the cushion ring associated with said one retainer ring is slipped over said substantially tubular portion of said one retainer ring and fits snugly thereover, with the radially inner face of said annular cushion ring resting against the radially outer face of said substantially tubular portion of said one retainer ring, and with the face of said annular cushion ring which axially faces away from said monolithic catalyst body in contact with the face of said flat arcuate portion of said one retainer ring which axially faces towards said monolithic catalyst body.

* * * * *